US006912876B2

(12) United States Patent
Wallis et al.

(10) Patent No.: US 6,912,876 B2
(45) Date of Patent: Jul. 5, 2005

(54) SHAPED BLANK

(75) Inventors: Steven Wallis, Nottingham (GB); Michael Starbuck, Earl Shilton (GB)

(73) Assignee: Sara Lee Corporation, Winston-Salem, NC (US)

( * ) Notice: Subject to any disclaimer, the term of this patent is extended or adjusted under 35 U.S.C. 154(b) by 37 days.

(21) Appl. No.: 10/719,687

(22) Filed: Nov. 21, 2003

(65) Prior Publication Data

US 2005/0109068 A1 May 26, 2005

(51) Int. Cl.[7] ..... A41B 9/00
(52) U.S. Cl. ..... 66/171
(58) Field of Search ..... 66/177, 189, 171, 66/172 R, 169 R

(56) References Cited

U.S. PATENT DOCUMENTS

| | | | | | |
|---|---|---|---|---|---|
| 1,746,790 | A | * | 2/1930 | Newman | 66/170 |
| 2,022,744 | A | * | 12/1935 | Shalette | 66/171 |
| 2,319,955 | A | * | 5/1943 | Smith, Jr. | 66/172 R |
| 4,043,156 | A | * | 8/1977 | Pernick | 66/177 |
| 5,031,424 | A | | 7/1991 | Peleg et al. | 66/177 |
| 5,379,613 | A | * | 1/1995 | Suzuki | 66/69 |
| 5,946,944 | A | | 9/1999 | Osborne | 66/176 |
| 5,992,182 | A | | 11/1999 | Lonati et al. | 66/41 |
| 6,125,664 | A | | 10/2000 | Browder, Jr. | 66/176 |
| 6,164,094 | A | | 12/2000 | Lonati et al. | 66/172 R |
| 6,514,120 | B1 | | 2/2003 | Hass | 450/65 |
| 2002/0112510 | A1 | | 8/2002 | Freeman | 66/202 |

* cited by examiner

*Primary Examiner*—Danny Worrell
(74) *Attorney, Agent, or Firm*—Ohlandt, Greeley, Ruggiero & Perle, L.L.P.

(57) ABSTRACT

A shaped blank has a body with a knitted section yarns disposed in a knitted direction. The body has an opening in the knitted section. The shaped blank has a fringe between the knitted section and the opening with the fringe being defined by each yarn of the yarns extending into the opening predetermined distance along the knitted direction. The predetermined distance is less than about two centimeters.

21 Claims, 6 Drawing Sheets

SHAPED BLANK

BACKGROUND OF THE INVENTION

1. Field of the Invention

The present invention relates to garments. More particularly, the present invention relates to a circularly knit shaped blank.

2. Description of the Related Art

Seamless circular knit garments are generally made from a tubular shaped blank. This blank forms articles of clothing such as an undershirt, brassieres, or an undergarment without any lateral seams. To assemble an article of clothing from the blank, such as a brassiere, one or more portions are removed from the blank. For example, armhole areas and neck hole areas are removed from the blank to define the brassiere.

Typically, a manual cutting operation is needed to form these respective openings. Although effective in producing the completed garment, it has been observed that these cutting operations are not productive, are time intensive, and are wasteful. They are detrimental because an area of the blank is knit, cut out, and then discarded.

Accordingly, there is a need for a shaped garment that eliminates one or more of the aforementioned drawbacks and deficiencies of the prior art.

SUMMARY OF THE INVENTION

It is an object of the present invention to provide a shaped blank that has a knitted section with a number of yarns disposed in a knitted direction, an opening formed therein, and a fringe disposed between the knitted section and the opening.

It is another object of the present invention to provide the shaped blank with the fringe defined by a number of yarns that extend into the opening a predetermined distance.

It is yet another object of the present invention to provide the shaped blank with the opening having loose yarns that are contiguous with the knitted section, and are not knitted, and extend into the opening.

It is still another object of the present invention to provide the shaped blank with the opening having loose yarns that are contiguous with the knitted section, and are not knitted, and that are uniform in length.

It is a further object of the present invention to provide the shaped blank with the opening having loose yarns that are contiguous with the knitted section, and are not knitted, and extend into the opening with at least one first yarn having a maximum length and at least one second yarn having a minimum length with the maximum and minimum length forming a ratio defined by the maximum length divided by the minimum length and where the ratio is in a range about 4.0 to about 1.0.

The above and other objects, advantages and benefits of the present invention will be understood by reference to the detailed description provided below and the accompanying drawings.

DETAILED DESCRIPTION OF THE INVENTION

Figure 1:
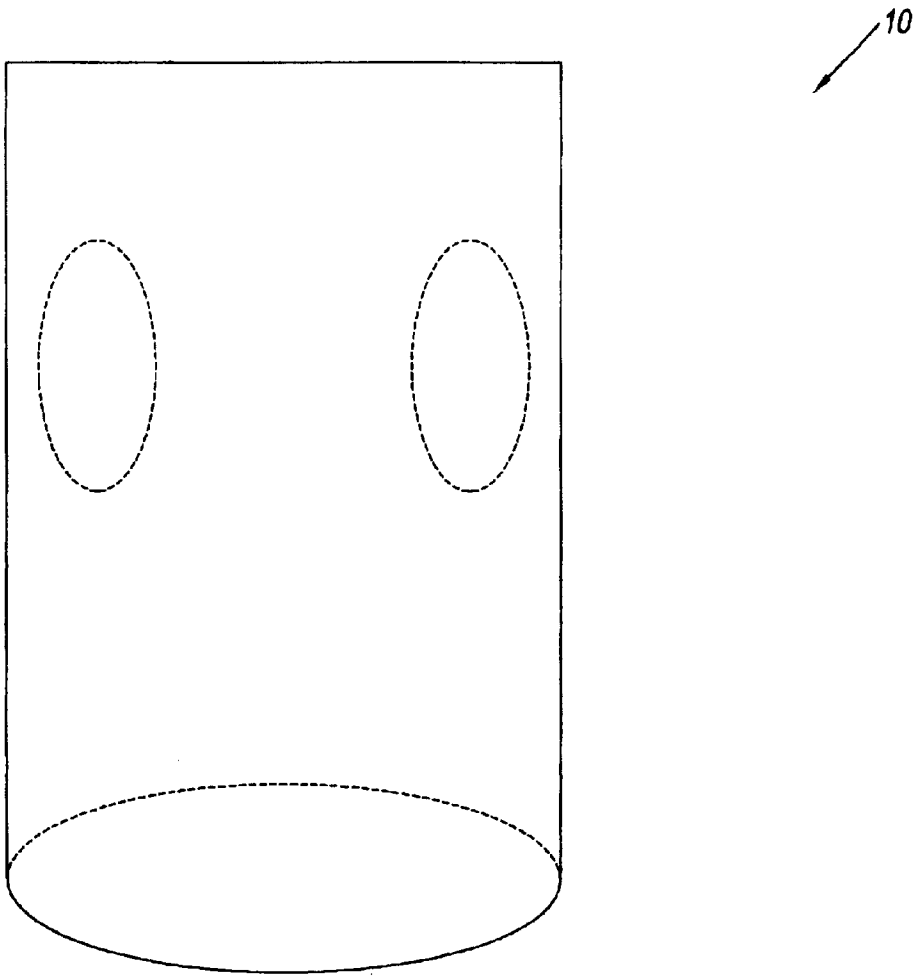
FIG. 1 is a perspective view of a tubular shaped blank of the prior art.

Referring to the drawings and, in particular, FIG. 1, there is provided a blank 10 known in the art that is knitted by a circular knitting machine. As is known, the completed articles usually have one or more openings on the blank 10. Thus, a manual cutting operation is needed to form the openings. It has been found that the openings on the blank 10 of FIG. 1 can be formed by slowing down the speed of operation of the circular knitting machine. Contemporaneous with that slow down, the circular knit machine prevents knitting in one or more locations of the garment, for example, where the armholes are located. However, this method of forming the blank 10 results in increased mis-stitching, stitch misplacing, flaws and otherwise poor quality garments, especially at a border or edging of the blank between the opening and the knitted section. These numerous mis-stitches render the final garment made by the blank 10 aesthetically displeasing. Thus, a manual trimming operation is still needed to render the final garment acceptable for sale to a customer. Further, the relatively slower, machine speed for forming the blank 10 with openings of FIG. 1 negates the benefits associated with circular knitting. In particular, the slow machine speed takes away from any benefit associated with the relatively high speed of circular knitting.

Figure 2:
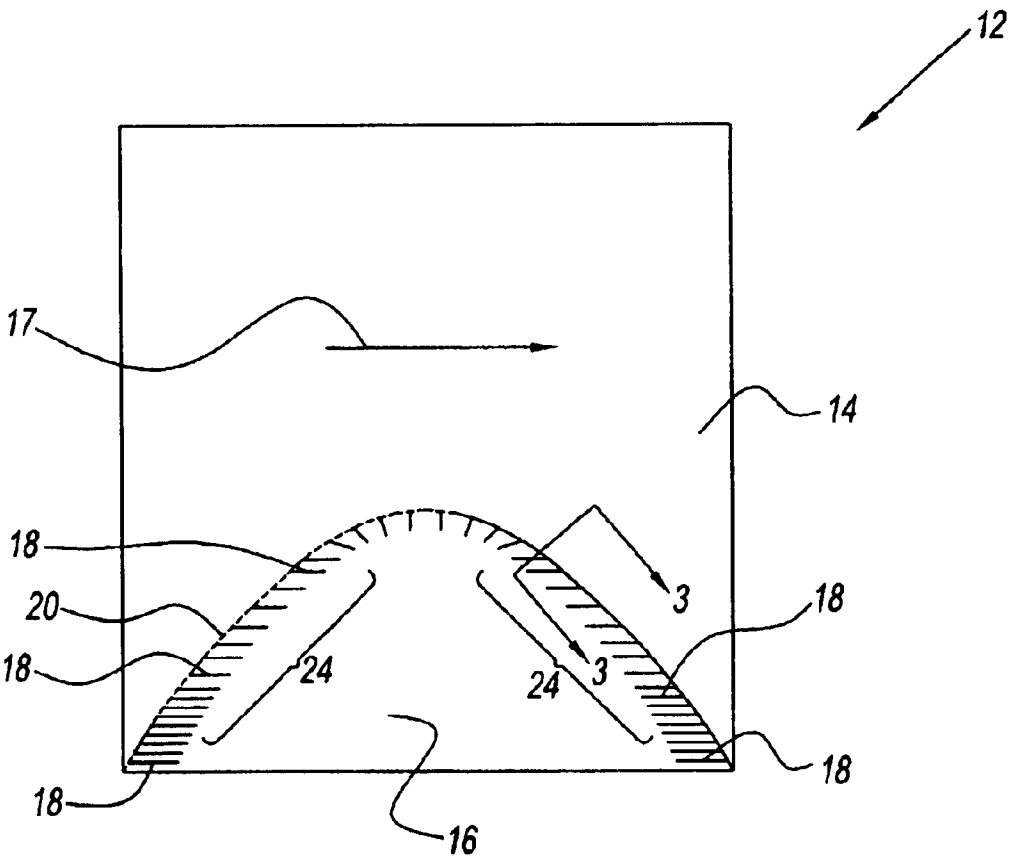
FIG. 2 is a side view of a shaped blank of the present invention having a first portion being removed to form a leg opening.

Referring to FIG. 2, the shaped blank 12 obviates any manual cutting and trimming operations associated with forming the openings of prior art blanks. Instead, the shaped blank 12 is knit with an opening 16 without slowing the speed of circular knitting machine from, for example, its typical speed of about 100 revolutions per minute. The shaped blank 12 has a knitted section 14 and the opening 16 being shown in a bottom of the shaped blank 12 forming a leg hole.

Although being shown as the leg hole, the opening 16 may form another feature of the shaped blank 12 such as an armhole, a neck hole, or any other features of the shaped blank.

The knitted section 14 preferably is a course of fabric that is formed by a first yarn. The first yarn is knit into stitches by the circular knitting machine. The shaped blank 12 is illustrated herein by way of example as a knit panty. Of course, it is contemplated by the present invention for the shaped blank 12 to form any finished garment, such as, but not limited to a brassiere, a head covering, hosiery, a shirt, a pair of pants, a trouser, a pair of shorts, hosiery, socks or any other article of clothing known in the art.

Advantageously, the shaped blank 12 of FIG. 2 obviates the necessity of a manual, post circular knit cutting operation. Instead, the shaped blank has the opening 16 with a fringe 24 that is attractive and neat. In a preferred embodiment of the present invention, the fringe 24 is attractive and neat because the fringe is made of loose yarns 18 that are all preferably uniform in length. In another embodiment of the present invention, the fringe 24 may have loose yarns 18 each having a length that is uniform and is less than about two centimeters. Alternatively, in another less preferable embodiment of the present invention, the fringe 24 may be made of loose yarns 18 that are not all uniform in length, but are still attractive and neat. In this embodiment, the fringe 24 is made of loose yarns 18 with at least one having a maximum length and at least one having a minimum length. In this embodiment, a ratio of the maximum length to the minimum length is in a range of about 4.0 to about 1.0. This ratio obviates the necessity of any trimming operation. In this embodiment, the maximum length is preferably about two centimeters and the minimum length of the loose yarns 18 is about one half centimeter. However, one skilled in the art will appreciate that the loose yarns may different maximum and minimum lengths but still within the ratio.

At a portion of the knitted section 14 where the opening 16 is desired, the circular knitting machine terminates knitting the first yarn (not shown) into number of knit stitches forming the knitted section 14 to form the opening 16 by having the one or more needles being at rest. Thereafter, the circular knitting machine allows the loose yarns 18 to come forward in a knitting direction 17 as a part of the knitted section 14 yet the loose yarns are not knit. Thereafter, the circular knitting machine cuts the knit stitches using a circular knitting machine cutter (not shown) to allow loose yarns 18 to extend into the opening 16. In this preferred embodiment, the loose yarns 18 are not visually apparent because the loose yarns are uniform in length. Thus, the shaped blank 12 has a neat, clean and finished appearance.

Figure 3:
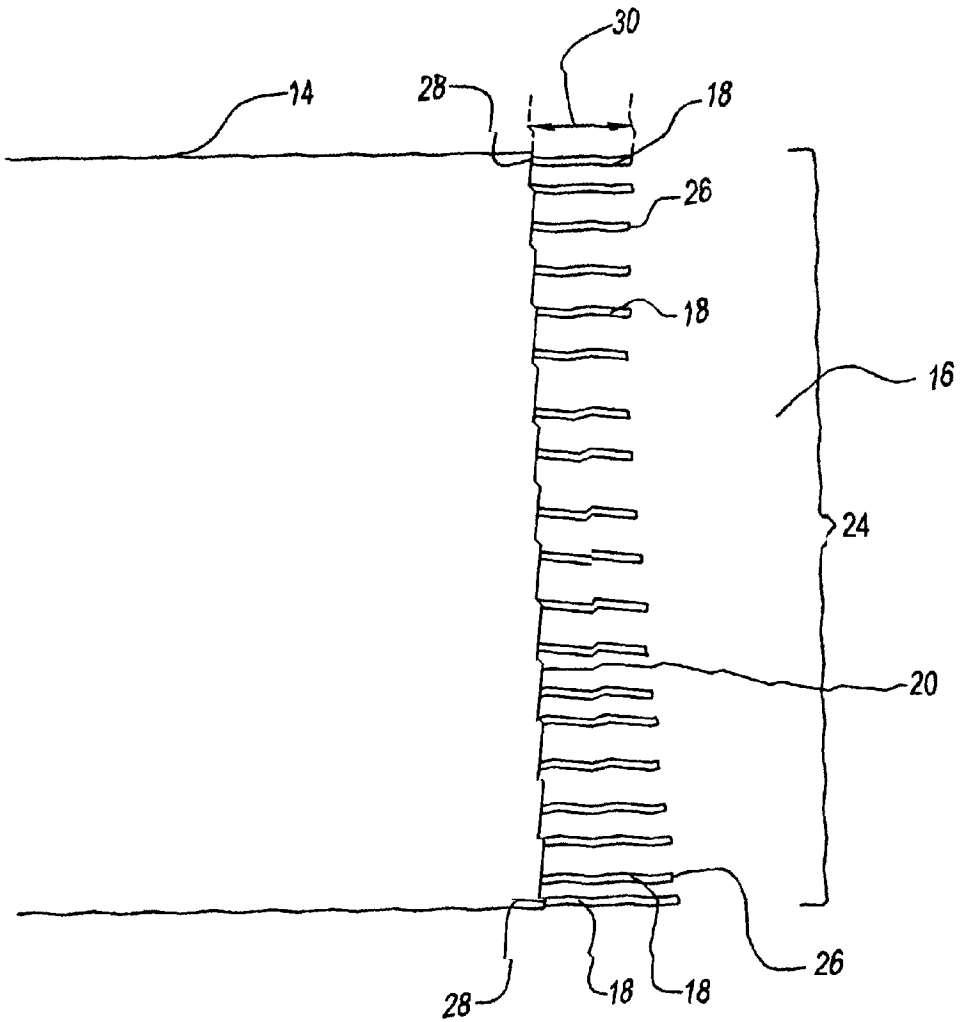
FIG. 3 is an enlarged view of a fringe of the shaped blank along line 3—3 of FIG. 2.

Referring again to FIG. 2, the shaped blank 12 is shown having the fringe 24. The fringe 24 is preferably attractive and neat and is made from the loose yarns 18 each having the preferred uniform length. Referring to a bottommost portion of the shaped blank 12, the shaped blank has a border 20 along with the fringe 24. The border 20 is a threshold between a last knitted stitch in the knitted section 14 and the opening 16. The loose yarns 18 are preferably a number of yarns that are contiguous with the border 20 and extend an amount into the opening 16. The loose yarns 18 extend entirely around the opening 16 as shown in FIG. 2, or alternatively may extend around a portion of the opening. Referring to FIG. 3, an enlarged view of the fringe 24 of the shaped blank 12 is shown along line 3—3 of FIG. 2. The fringe 24 preferably has the loose yarns 18 with each loose yarn having an end 26. The end 26 is disposed in the opening 16 opposite the knitted section 14.

As shown, the loose yarns 18 may be made of any material known in the art including flat nylon ground yarn, a cotton yarn, a bare elasthane, an elastomeric yarn, a nylon elasthane, a polyester, a polyester elasthane, spandex, wool, silk, linen, or any combinations thereof. Preferably, the loose yarns 18 are the same material that forms the knitted section 14.

Each loose yarn 18 has a base portion 28 that is connected to the border 20 of the knitted section 14. The base portion 28 is shown as portion of each loose yarn 18 that is contiguous with the last knitted stitch in the knitted section 14 or border 20. The end 26 is a portion of each loose yarn 18 opposite the base portion 28. Each loose yarn 18 also has a length 30. The length 30 is defined by measuring each loose yarn 18 from the base portion 28 to the end 26.

In prior art blank openings, the openings have yarn extending from the opening with each of the yarns having different and random lengths with a relatively larger difference in length between the loose yarns adjacent to one another. This different and random lengths of the prior art blanks is unacceptable, and produces a jagged appearance and necessitates the trimming operation. Referring to FIG. 3, preferably the shaped blank 12 has the loose yarns 18 each having a length 30 that is uniform. Uniform is defined as each loose yarn 18 of the number of loose yarns 18 having substantially the same length 30. Preferably, the length 30 of the loose yarns 18 are identical so the fringe 24 does not necessitate any trimming. Thus, the uniformity in the length 30 provides for an overall clean and neat appearance of the fringe 24.

Figure 4:
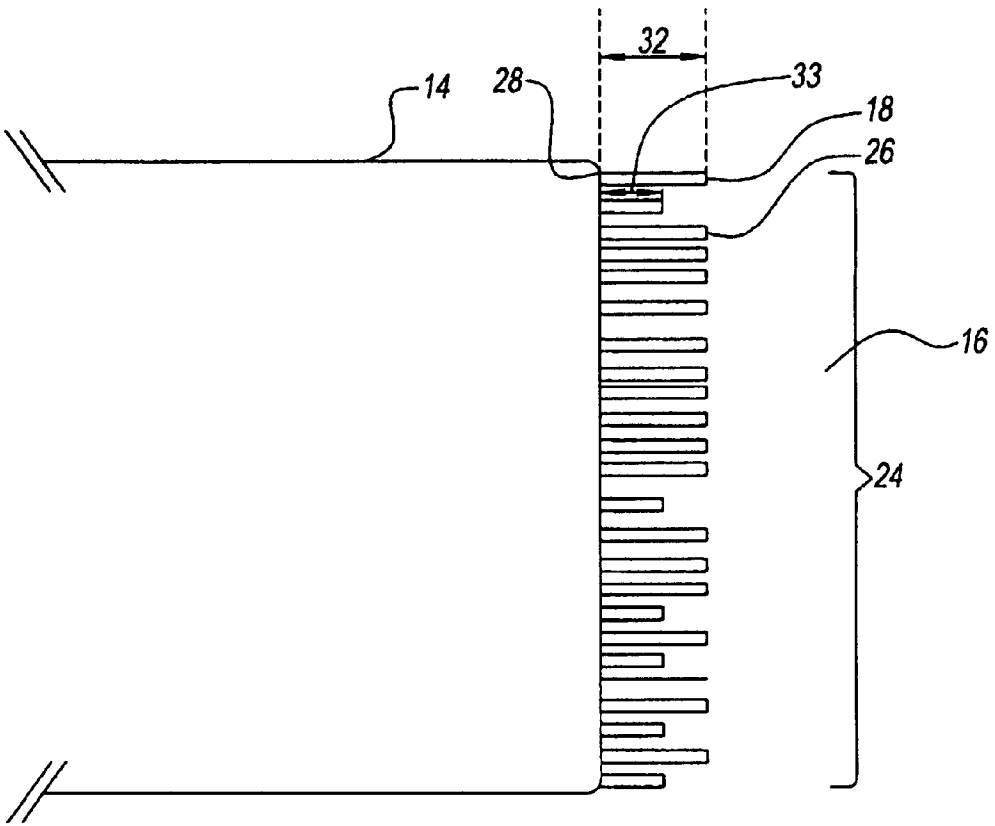
FIG. 4 is an enlarged view of another embodiment of the fringe of the shaped blank along line 3—3 of FIG. 2.

In another less preferable embodiment shown in FIG. 4, the fringe 24 may be made from loose yarns 18 that are not all strictly uniform in length. In this less preferable embodiment, the fringe 24 has the loose yarns 18 with a length that allows the fringe to be attractive and neat since the length 30 is formed in a range. The range allows the fringe to appear attractive and neat, thus not necessitating any trimming. The fringe 24 has loose yarns 18 with a maximum length 32 and a minimum length 33. Preferably, the maximum length 32 of the loose yarn 18 is about two centimeters and the minimum length 33 of the loose yarn 18 is about one half centimeter.

In still another less preferred embodiment, the fringe 24 has loose yarns 18 with the length being defined by a ratio of a longest yarn to a shortest yarn or the maximum length 32 to the minimum length 33. This ratio is preferably calculated by dividing the maximum length 32 by the minimum length 33 and is preferably in a range that includes between about 4.0 and about 1.0. In still another embodiment, the ratio may be in a range that includes between about 2.0 to about 1.0.

Figure 5:
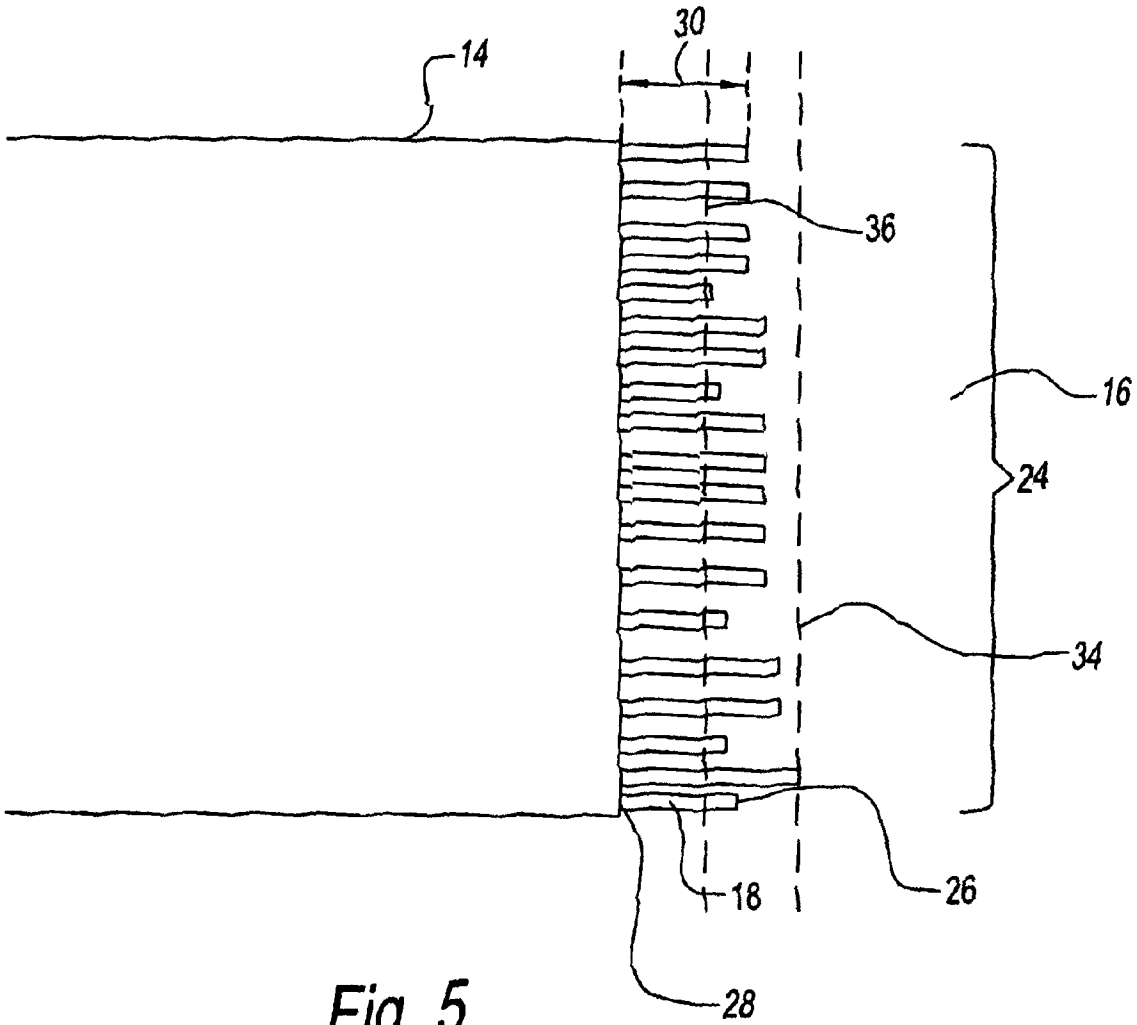
FIG. 5 is an enlarged view of yet another embodiment of the fringe of the shaped blank along line 3—3 of FIG. 2.

Referring to FIG. 5, in another embodiment, the fringe 24 has loose yarns 18 with the length 30 being formed according to a first line of demarcation 34. In this embodiment, the loose yarns 18 may all be formed with the length 30 that does not exceed the first line of demarcation 34. In another embodiment, the loose yarns 18 may be formed with the length 30 that is the same as the first line of demarcation 34.

The first line of demarcation 34 preferably is at about two centimeters away from the border 20 of each loose yarn 18. In still another embodiment, the first line of demarcation 34 may be indicative of the maximum length plus or minus an error of substantially all the loose yarns 18 collectively at the fringe 24. However, one skilled in the art should appreciate that the first line of demarcation 34 may be any length known in the art to impart a clean and neat overall appearance to the fringe 24 and the opening 16 of the shaped blank 12.

The fringe 24 has loose yarns 18 with the length 30 being formed according to a second line of demarcation 36. In one embodiment, the fringe 24 may be formed with loose yarns 18 all with the length 30 that preferably exceeds and does not fall below the second line of demarcation 36. In another embodiment, the fringe 24 may be formed with loose yarns 18 that have the length 30 that is substantially the same as the second line of demarcation 36. The second line of demarcation 36 preferably indicates the minimum length 33 of the loose yarns 18 between the knitted section 14 and the opening 16 at the fringe 24. One skilled in the art should appreciate that the second line of demarcation 36 may be determined as any suitable length known in the art to impart a clean and neat overall appearance to the opening 16.

This uniformity in the length 30 of the loose yarns 18 in the fringe 24 extends around the opening 16 of the shaped blank 12. This obviates any post circular knitting cutting process, and thereby increases productivity of the overall manufacturing of the shaped blank 12 yet allows the opening 16 to have a neat, and clean overall appearance.

The length 30 of each loose yarn 18 depends on a material that forms the loose yarns. There exists a difference in the length 30 of the loose yarn 18 when knitting the knitted section 14 using a non-elastic yarn versus an elastic yarn. The elastic yarns will stretch an amount, and the length 30 of the loose yarns 18 is generally relatively longer when each loose yarn is formed from one or more elastic yarns as compared to non-elastic yarns. Conversely, the length 30 of each loose yarn 18 is generally relatively shorter when each loose yarn 18 is formed from one or more non-elastic yarns. Accordingly, the fringe 24 can potentially be shorter when each loose yarn 18 is formed from one or more non-elastic yarns as compared to one or more elastic yarns.

Figure 6:
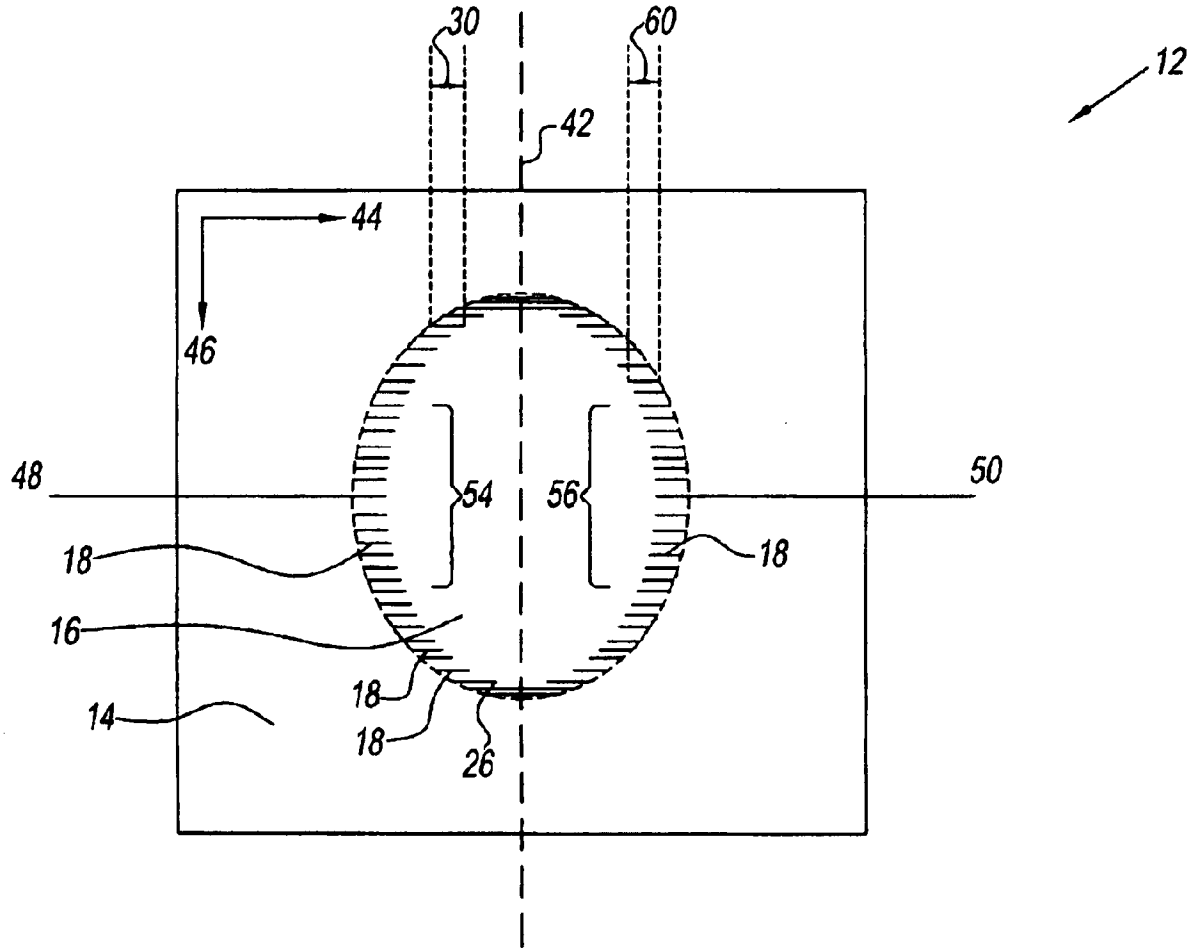
FIG. 6 is a side view of another embodiment of the shaped blank of FIG. 2.

Referring to FIG. 6, there is shown a side view of another embodiment of the present invention for the shaped blank 12. In this embodiment, the shaped blank 12 has the opening 16 as an armhole for a brassiere. The shaped blank 12 is tubular in shape and has a longitudinal axis 42. The shaped blank 12, which is circular knit, is formed in a first knit direction 44 and a second knit direction 46. As shown in this embodiment, the opening 16 is substantially circular in shape, however the opening may have any shape known in the art including elliptical, rectangular, polygonal, or any combinations thereof. One skilled in the art should appreciate that the opening 16 may be formed in any suitable location on the shaped blank 12, or on multiple locations of the shaped blank.

The opening 16 has a first lateral side 48 and a second lateral side 50. The second lateral side 48 is opposite the first lateral side 50. Forming the opening 16 during circular knitting is advantageous since it can potentially reduce material loss to about thirty percent of the material versus the prior art blank 10.

In this embodiment, the opening 16 is formed with loose yarns 18 on both the first lateral side 48 and the second lateral side 50 as is shown. The knitted section 14 of the shaped blank 12 preferably is knit in conventional knit stitches, tuck stitches, plain stitches, float stitches, or any combinations thereof.

The shaped blank 12 may be formed with the knitted section 14 that has yarn with softness properties, comfort properties, or wicking properties. The knitted section 14 may also have a pattern, one or more lines, floral representation, a visual presentation, a sheer effect, or any combinations thereof on an outer or inner side of the shaped blank 12.

Referring to the embodiment shown in FIG. 6, the shaped blank 12 is formed with the opening 16 that has a first fringe 54 and a second fringe 56. The first fringe 54 and the second fringe 56 preferably give a clean and neat appearance to the opening. The first fringe 54 is located on the first lateral side 48 and the second fringe 56 is located on a second lateral side 50 of the opening 16. The first fringe 54 is opposite the second fringe 56.

The first fringe 54 and the second fringe 56 are preferably each formed from the loose yarns 18. At first lateral side 48 of the opening 16, the circular knitting machines terminates knitting the knitted section 14 and allows the loose yarn 18 to extend in the first knitted direction 44 into the opening 16. Then, the circular knitting machine cuts the loose yarn thereby forming the first fringe 54.

Thereafter, the circular knitting machine preferably retains an amount of second yarn (not shown) in the circular knitting machine forming the knitted section 14. The second yarn is held and not knitted. After the opening 16 is completed, the second yarn is thereafter reintroduced into the knitted section 14 in the second lateral side 50 at a speed of operation of about 100 revolutions per minute. The circular knitting machine holds the second yarn, without knitting the second yarn into stitches, to form the second fringe 56. After completing the second fringe 56, the second yarn is knit into knit stitches to form knitted section 14 at the second lateral side 50 in the knitted direction 44.

In another embodiment, a tensile stress may be applied to the yarn. The tensile stress is preferably used when the knitted section is an elastic yarn. Preferably, the tensile stress is applied to the second yarn to stretch the second yarn a predetermined amount, and thus better manipulate the second yarn. Referring again to the opening 16 in FIG. 6, the second yarn is retained with the tensile stress imparted thereon. Thereafter, the second yarn is reintroduced into the second lateral side 50 after the opening 16 is formed. When reintroduced, the second yarn is knit into the knitted section 14 at the second lateral side 50. This tensile stress permits easier manipulation of the loose yarns 18 to form the second fringe 56 thereby facilitating formation of the second fringe 56 with a second length 60.

The second length 60 of the loose yarns is preferably shorter than the length 30. The length 60 at the second fringe 56 is shorter due to the amount of tension imparted thereon. In one embodiment, the first length 30 may be about two centimeters and the second length 60 may be about onehalf centimeter. In an alternative embodiment, the second length 60 may be equal to the length 30.

It should be understood that the foregoing description is only illustrative of the present invention. Various alternatives and modifications can be devised by those skilled in the art without departing from the invention. Accordingly, the present invention is intended to embrace all such alternatives, modifications and variances.

What is claimed is:

1. A shaped blank comprising:

a body having a knitted section with a plurality of yarns disposed in a knitted direction, said body having an opening in said knitted section; and a fringe being between said knitted section and said opening, said fringe being defined by each yarn of said plurality of yarns extending into said opening a predetermined distance along said knitted direction, said predetermined distance being less than about two centimeters, wherein said knitted section terminates at a knit stitch.

2. The shaped blank of claim 1, wherein said predetermined distance is greater than or equal to about one half centimeter.

3. The shaped blank of claim 1, wherein said predetermined distance is about one centimeter to about one half centimeter.

4. A shaped blank comprising:

a body having a knitted section with a plurality of yarns disposed in a knitted direction, said body having an aperture in said knitted section and each yarn of said plurality of yarns extending a length along said knitted direction into said aperture, said plurality of yarns having a first yarn with a maximum length relative to said length, said plurality of yarns having a second yarn with a minimum length, wherein said maximum length and said minimum length form a ratio defined by said maximum length divided by said minimum length, and wherein said ratio is in a range that includes about 4.0 to about 1.0.

5. The shaped blank of claim 4, wherein said maximum length is about two centimeters.

6. The shaped blank of claim 4, wherein said minimum length is about one half centimeter.

7. A shaped blank comprising:

a body having a knitted section with a plurality of yarns disposed in a knitted direction, said body having an aperture in said knitted section and each yarn of said plurality of yarns extending a length along said knitted direction into said aperture, said plurality of yarns having a first yarn with a maximum length relative to said length, said plurality of yarns having a second yarn with a minimum length, wherein said maximum length and said minimum length form a ratio defined by said maximum length divided by said minimum length, and wherein said ratio is in a range that includes about 4.0 to about 1.0, wherein said aperture has a first side portion and a second side portion each on a circumference of said aperture, said first side portion being opposite said second side portion, said plurality of yarns extending in said knitted direction on said first side portion and said plurality of yarns extending opposite said knitted direction on said second side portion, wherein said plurality of said yarns on said first side portion have a different length relative to said plurality of yarns on said second side portion.

8. The shaped blank of claim 7, wherein said plurality of yarns on said second side portion are about one half centimeter in length.

9. The shaped blank of claim 7, wherein said plurality of yarns on said second side portion are tensioned.

10. A shaped blank comprising:

a body having a knitted section with a plurality of yarns disposed in a knitted direction, said knitted section being formed with a first line of demarcation, said body having an opening in said knitted section, said opening commencing at said first line of demarcation, wherein the shaped blank has a plurality of yarns, each yarn of said plurality of yarns having a length, said plurality of yarns forming a fringe between said knitted section and said opening, and wherein said length of each of said plurality of yarns is substantially uniform with regard to a remainder of said plurality of yarns so that said fringe does not necessitate any trimming.

11. The shaped blank of claim 10, wherein said plurality of yarns have a maximum length and a minimum length at said fringe, and wherein said length is between said maximum length and said minimum length.

12. The shaped blank of claim 1, wherein said plurality of yarns are made of a material selected from the group consisting of elasthane, a nylon, a polyester, a cotton, an elastomeric yarn, a spandex, wool, silk, linen, and any combinations thereof.

13. The shaped blank of claim 10, wherein said substantially uniform length is about two centimeters to about one half centimeter.

14. The shaped blank of claim 10, wherein said length of said plurality of yarns at said fringe depends on a material forming said plurality of yarns, said material being selected from the group consisting of elasthane, a nylon, a polyester, a cotton, an elastomeric yarn, a spandex, wool, silk, linen, and any combinations thereof.

15. The shaped blank of claim 10, wherein said opening is in a first lateral side of the shaped blank and a second opening is in a second lateral side of the shaped blank.

16. The shaped blank of claim 10, wherein said knitted section and said opening are both circular knit at a speed of operation of about 100 revolutions per minute.

17. A shaped blank comprising:

a body having a knitted section with a plurality of yarns disposed in a knitted direction, said knitted section being formed with a first line of demarcation, said body having an opening in said knitted section, said opening commencing at said first line of demarcation, wherein the shaped blank has a plurality of yarns, each yarn of said plurality of yarns having a length, said plurality of yarns forming a fringe between said knitted section and said opening, and wherein said length of each of said plurality of yarns is substantially uniform with regard to a remainder of said plurality of yarns, wherein said opening has a first lateral side and a second lateral side, said first lateral side being at a first radial position of said opening and said second lateral side being opposite said first lateral side at a second radial position, wherein said plurality of yarns are tensioned at said second lateral side.

18. The shaped blank of claim 10, wherein the shaped blank forms a garment selected from the group consisting of a panty, a pair of shorts, a brassiere, a shirt, a sock, hosiery, a head covering, and any combinations thereof.

19. The shaped blank of claim 18, wherein said opening forms a feature of said garment, said feature being selected from the group consisting of a neck opening, a waist opening, an arm opening, a leg opening, and any combinations thereof.

20. The shaped blank of claim 10, wherein said plurality of yarns each have a base portion, said base portion being integral with a knitted stitch of said knitted section.

21. The shaped blank of claim 10, further comprising an amount of a material forming said knitted section, wherein said amount is about a thirty percent below a total amount of material forming a blank without said opening.

* * * * *